United States Patent [19]

Roller et al.

[11] Patent Number: 5,009,470

[45] Date of Patent: Apr. 23, 1991

[54] LATERAL FILE DRAWER POSITIONLOCK

[75] Inventors: Timothy J. Roller, Ashville, N.Y.; Robert E. Thiele, Wexford, Pa.

[73] Assignee: Adanlock, Jamestown, N.Y.

[21] Appl. No.: 354,742

[22] Filed: May 22, 1989

[51] Int. Cl.[5] ..... A47B 88/00

[52] U.S. Cl. ..... 312/325; 312/328

[58] Field of Search ..... 312/325, 328, 245, 248, 312/228, 348

[56] References Cited

U.S. PATENT DOCUMENTS

| | | | |
|---|---|---|---|
| 1,799,521 | 4/1931 | Levine | 312/325 X |
| 2,420,015 | 5/1947 | Salsman et al. | 312/325 |
| 2,875,015 | 2/1959 | Higberg | 312/325 |
| 3,510,188 | 5/1970 | Brown | 312/325 |
| 4,372,480 | 2/1983 | Mitchell et al. | 312/325 X |
| 4,729,616 | 3/1988 | Vogt | 312/325 |
| 4,756,054 | 7/1988 | Mitts et al. | 16/370 X |

*Primary Examiner*—Joseph Falk

*Attorney, Agent, or Firm*—Drucker & Sommers

[57] ABSTRACT

A lateral file cabinet hinge that secures the file drawers in an open position or in a closed position. The means to secure the drawer in a closed position also slows the drawer before it is fully closed.

2 Claims, 1 Drawing Sheet

Fig. 1
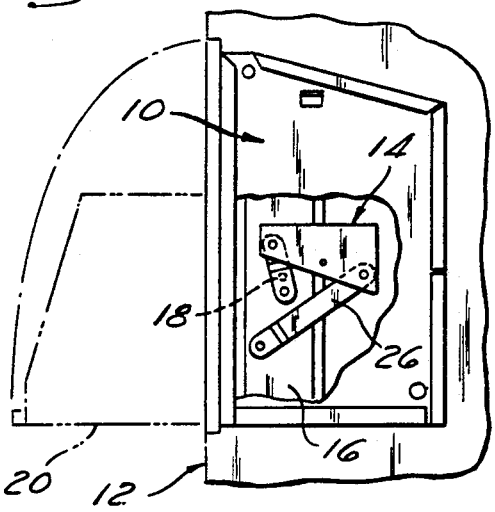
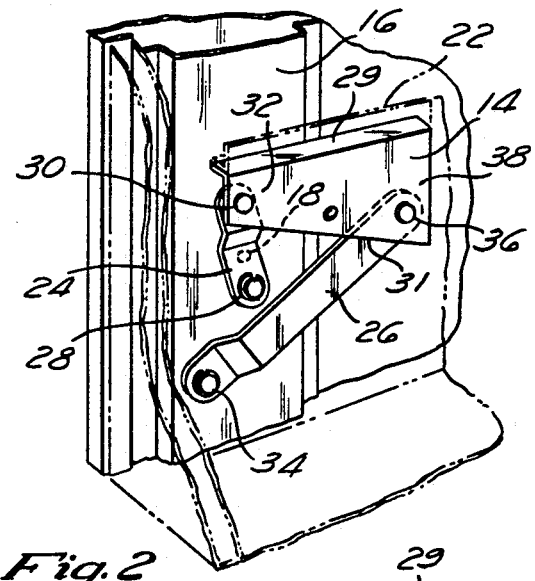
Fig. 2
Fig. 7
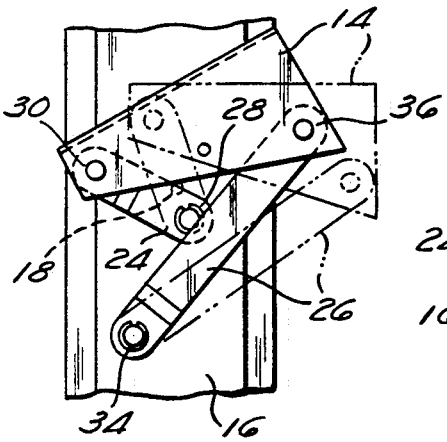
Fig. 3
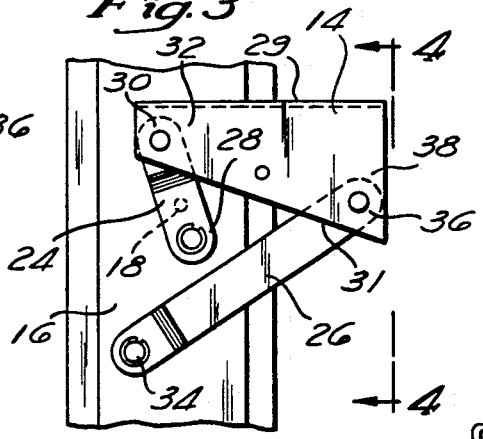
Fig. 4
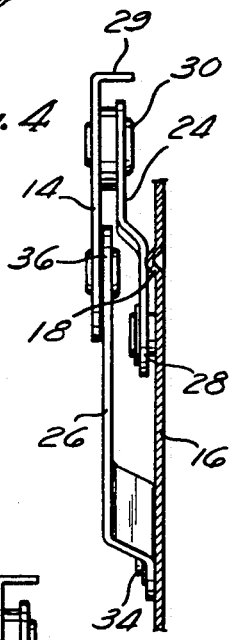
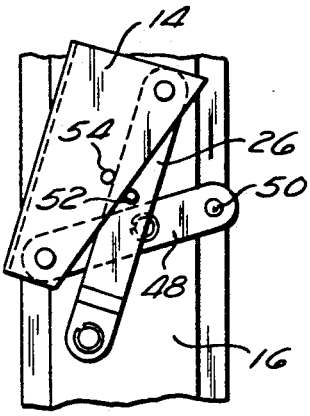
Fig. 8
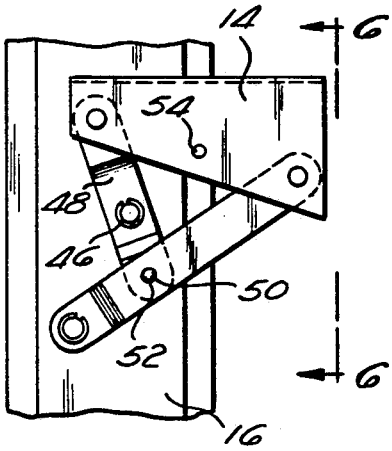
Fig. 5
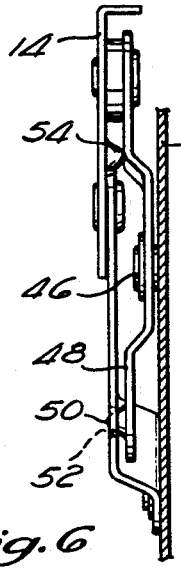
Fig. 6

LATERAL FILE DRAWER POSITIONLOCK

BACKGROUND OF THE INVENTION

This invention relates to Office furniture, particularly to lateral file cabinets.

Lateral filing cabinets are those that have a drawer and that generally file side to side. Most lateral file drawers slide out while the cabinet referred to in this invention rocks or rotates forward. In the closed position a standard file jacket can be thought of as lying on its side; in the open position it rests on its back. A lateral filing cabinet is disclosed in U.S. Pat. No. 2,785,015 issued to Higberg.

In the embodiment disclosed therein, the drawer is secured in the open position by an opening on one linkage arm and an engagement projection on a second linkage arm.

U.S. Pat. No. 2,875,011 also issued to Higberg teaches a latch and lock mechanism for keeping lateral file drawers closed. However, neither of the two teachings teach any means of securing a lateral file cabinet door in the closed position absent a latch and lock mechanism on each door of the lateral file cabinet.

It would be advantageous to have a cabinet hinge that secured each file drawer closed in the absence of a lock on each drawer. This would separate the functions of keeping the drawers closed and locking the cabinet. The cabinet could be locked by the use of one gang lock to lock all drawers in the cabinet.

Such securing mechanism would advantageously incorporate the feature of slowing a closing door before it was fully closed, thereby avoiding a sudden stop.

SUMMARY OF THE INVENTION

This invention provides a lateral file cabinet hinge that secures the file drawers in an open position or in a closed position. The means to secure the drawer in a closed position also slows the drawer before it is fully closed.

An aspect of this invention is a drawer hinge for a drawer on a lateral file comprising:

a drawer saddle attachable to a drawer;

a first linkage arm, hingeably attached at a first end to a side of a lateral file and at a second end to a first end of said drawer saddle and having a first means for mating;

a second linkage arm hingeably attached at the first end at the side of the lateral file and at a second end to a second end of said drawer saddle; and a retaining means for engaging said first means for securing the drawer in a closed position.

A further aspect of this invention is a drawer hinge for a drawer on a lateral file comprising:

a drawer saddle attachable to a drawer;

a first linkage arm hingeably attached at a first end to a side of a lateral file and at a second end to a first end of said drawer saddle and a first means for mating;

a second linkage arm hingeably attached at a first end to a side of a lateral file and at a second end to a second end of said drawer saddle and a second means for mating and a third means for mating; and said first means for mating engaging said second means for mating when the drawer is in a closed position, said first means for mating engaging said third means for mating when the drawer is in an open position.

BRIEF DESCRIPTION OF THE DRAWINGS

FIG. 1 shows a side elevation view of the positionlock of the present invention in the closed position.

FIG. 2 shows a perspective view of the position lock of the present invention in the closed position.

FIG. 3 shows a side elevation view of the positionlock of the present invention in the closed position.

FIG. 4 is a front elevation view of the positionlock of FIG. 3.

FIG. 5 is a side elevation view of an alternate embodiment of the positionlock of the present invention in closed position.

FIG. 6 is a front elevation view of the positionlock of FIG. 5.

FIG. 7 is the positionlock of FIG. 3 rotated to a position intermediate between open and closed.

FIG. 8 is the positionlock of FIG. 7 rotated to the fully open position.

DETAILED DESCRIPTION OF THE INVENTION

Referring to FIG. 1, a drawer 10 in a lateral file cabinet 12 is in the closed position. The drawer is supported by the drawer saddle 14, which is hingeably attached to the cabinet reinforcing hat bracket stud 16 mounted on the side of the file cabinet. The hinge of this invention is urged to remain in the closed position by a means for securing the drawer in a closed position. A dimple 18 extends out from the stud to engage the arm, thereby securing it.

When the drawer rotates forward into the open position FIG. 1 (shown in phantom) and the files contained therein are available for use. The files are supported on the file support surface 20 when the drawer is open. When the drawer is closed, the outside surface of the file support surface is exposed as the outside surface of the drawer.

Referring now to FIG. 2, the drawer has a bracket 22 that rests on and is attached to the drawer saddle 14. Therefore, the drawer rotates forward by a hingeable connection to the file cabinet by a first linkage arm 24 and a second linkage arm 26. The first linkage arm is rotatably attached at a first end 28 to the stud 16 of the lateral file cabinet. The first linkage arm is rotatably connected at a second end 30 to a first end of the drawer saddle 32. The rotatable connection means at the first and second ends can be either removable or unremovable, for example, rivets, bolts, and similar fasteners well known in the art. A bolt secured by a "C" clip is shown.

The second linkage arm is rotatably connected at a first end 34 to the stud of the file cabinet, and at a second end 36 is attached to a second end of the drawer saddle 38.

Referring to FIGS. 3 and 4, the drawer is closed the first linkage arm 24 and the second linkage arm 26 support the drawer saddle 14 so the top surface 29 of the saddle is horizontally disposed. The bottom edge 31 of the drawer saddle slopes relative to the top surface, allowing the first linkage arm to attach to the first end of the saddle 32 at a point higher than the attachment point of the second linkage arm on the second end. The first linkage arm is secured in the closed position by dimple 18 in the side of the stud 16. The pressure exerted by the dimple on the first linkage arm holds the drawer in a closed position. The dimple provides pressure before the drawer is fully closed, thereby preventing sudden stops.

Referring to FIGS. 5 and 6, in an alternative embodiment, a first arm has a hingeable attachment to the file cabinet stud about midway along the arm's length. An elongate member 48 extends far enough to intersect with the second arm. A first receivable dimple 50 on the elongated member is received by an aperture 52 in the second arm. The saddle is therefore secured in the closed position.

A second receivable 54 dimple on the saddle engages the aperture when the drawer is opened, thereby securing it in the opened position.

Referring to FIG. 7 the saddle can be rotated forward when the attached drawer is moved. As the drawer moves, the retaining dimple 18 slides past the first arm, thereby allowing the drawer to freely swing open.

Referring to FIG. 8 the same fundamental movements of the first and second arms move the saddle forward in the alternative embodiment. As the drawer nears the full open position the second receivable dimple on the saddle approaches the aperture in the second arm. The drawer is secured open when the second receivable dimple is received into the aperture. The first receivable dimple contacts the second arm before the drawer is fully closed, thereby preventing sudden stops.

We claim:

1. A mounting for a front opening drawer rotatable from a closed position to an open position comprising:

a cabinet side;

a drawer mounting saddle rotatably connected to a first linkage arm and a second linkage arm; said first linkage arm and said second linkage arm rotatably mounted to said cabinet side such that the first linkage arm and the second linkage arm are in continuous non-parallel orientation during rotation from the open position to the closed position, and said first linkage arm and said second linkage arms intersect in the closed position;

an engagement member on the first linkage arm; and a reception aperture on the second linkage arm to receive the engagement member when the drawer is in the closed position.

2. The drawer of claim 1, including engagement means to secure the door open.

* * * * *